US007387177B2

(12) United States Patent
Zahradnik et al.

(10) Patent No.: US 7,387,177 B2
(45) Date of Patent: Jun. 17, 2008

(54) BEARING INSERT SLEEVE FOR ROLLER CONE BIT

(75) Inventors: Anton F. Zahradnik, Sugarland, TX (US); Terry J. Koltermann, The Woodlands, TX (US); Don Q. Nguyen, Houston, TX (US); Aaron J. Dick, Houston, TX (US); Eric Sullivan, Houston, TX (US); Scott Shiqiang Shu, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/582,684

(22) Filed: Oct. 18, 2006

(65) Prior Publication Data

US 2008/0093128 A1 Apr. 24, 2008

(51) Int. Cl.
*E21B 10/22* (2006.01)

(52) U.S. Cl. ..... 175/371; 175/372; 384/95

(58) Field of Classification Search ..... 175/353, 175/371, 372, 374, 376; 384/92, 95
See application file for complete search history.

(56) References Cited

U.S. PATENT DOCUMENTS

| | | | | |
|---|---|---|---|---|
| 2,013,839 | A * | 9/1935 | Pickin | 175/340 |
| 4,478,299 | A * | 10/1984 | Dorosz | 175/369 |
| 4,499,642 | A * | 2/1985 | Vezirian et al. | 29/898.058 |
| 4,514,098 | A * | 4/1985 | Ippolito | 384/95 |
| 4,625,816 | A | 12/1986 | Takano | |
| 4,763,736 | A * | 8/1988 | Varel, Sr. | 175/341 |
| 4,825,964 | A * | 5/1989 | Rives | 175/371 |
| 4,865,137 | A * | 9/1989 | Bailey et al. | 175/269 |
| 4,874,047 | A | 10/1989 | Hixon | |
| 4,899,838 | A | 2/1990 | Sullivan et al. | |
| 4,903,786 | A * | 2/1990 | Welsh | 175/367 |
| 4,934,467 | A | 6/1990 | Langford, Jr. | |
| 5,005,989 | A | 4/1991 | Karlsson | |
| 5,295,549 | A * | 3/1994 | Dolezal et al. | 175/371 |
| 5,570,750 | A | 11/1996 | Williams | |
| 6,053,264 | A * | 4/2000 | Frankel et al. | 175/371 |
| 6,220,374 | B1 | 4/2001 | Crawford | |
| 6,260,635 | B1 * | 7/2001 | Crawford | 175/371 |
| 2001/0042644 | A1 | 11/2001 | Nishiyama et al. | |
| 2002/0108788 | A1 | 8/2002 | Peterson et al. | |
| 2004/0000435 | A1 | 1/2004 | Nguyen | |
| 2004/0031625 | A1 * | 2/2004 | Lin et al. | 175/371 |

* cited by examiner

*Primary Examiner*—Jennifer H Gay
*Assistant Examiner*—Daniel P Stephenson
(74) *Attorney, Agent, or Firm*—Bracewell & Giuliani LLP

(57) ABSTRACT

An earth boring bit has a bearing pin with a sleeve mounted on it. The sleeve is fixed against rotation but able to float relative to the bearing pin. A cone fits over and forms a bearing surface with the sleeve. The sleeve and bearing pin are configured to have a clearance between them that has a forward portion that progressively decreases in a rearward direction. The clearance progressively decreases in a forward direction from the rearward end of the sleeve. The cone and the sleeve are able to tilt in unison with each other relative to the bearing pin when the bit is loaded.

19 Claims, 4 Drawing Sheets

11
29
37
17
27
33
13
41
21
31
19
15
23
35
45
14
25

35
29
39
31
45
27
23
41b
13
17
37
41a
43

BEARING INSERT SLEEVE FOR ROLLER CONE BIT

FIELD OF THE INVENTION

This invention relates in general to rolling cone earth-boring bits, and in particular to an insert ring that is mounted between the bearing pin and the cone bearing surfaces.

BACKGROUND OF THE INVENTION

A typical roller cone earth-boring bit has a bit body with three bit legs. A bearing pin extends from each bit leg, and a cone rotatably mounts on the bearing pin. The bearing surfaces between the cavity of the cone and the bearing pin are filled with lubricant. A seal is located between the cone and the bearing pin to seal lubricant within and keep drilling fluid from entering.

During operation, a high downward force is imposed on the drill bit from the weight of the drill string. The downward force transmits through the bit body and bearing pin to the cone. Even though the clearances between the bearing surfaces are quite small, slight misalignment of the cone bearing surface with the bearing pin tends to occur. This slight misalignment can result in uneven contact stress.

The seal between the cone and the bearing pin for sealing lubricant is also affected by the load imposed on the bit. Typically, the contact pressure will be greater on the lower side of the seal than on the upper side. Varying seal contact pressure can be caused by misalignment of the cone bearing surface and bearing pin. Changes in contact pressure can cause excessive heat in certain areas of the seal, shortening the life.

SUMMARY OF THE INVENTION

The bit of this invention has an insert mounted on the bearing pin that has an outer bearing surface. A cone has a cavity with an inner bearing surface that slidably receives the insert. An exterior portion of the bearing pin and an inner portion of the insert are configured to define a radial clearance between them that progressively changes along a portion of a length of the bearing pin when the cone and bearing pin are concentric. When the bit is loaded, the bearing surfaces of the insert and the cone remain substantially parallel but may tilt slightly relative to the bearing pin.

Preferably the clearance varies along the length of the bearing and is greater at the forward and rearward ends of the insert than in the central part of the insert. In one embodiment, the clearance is formed by contours on the inner surface of the insert and the mating exterior portion of the bearing pin remains cylindrical. In another embodiment, the clearance is formed by contours formed on the bearing pin. The inner surface of the insert remains cylindrical.

In one embodiment, the insert serves only as a bearing member, and the seal for the cone and the bearing pin is located rearward of the sleeve. In another embodiment, the insert comprises a sleeve that extends to the rearward end of the bearing pin. An outer seal is located between the outer diameter of the sleeve and the cone. An inner seal is located between the bearing pin and the inner diameter of the sleeve in that embodiment.

In another embodiment, the insert comprises a segment of a sleeve. The segment is located within a recess formed on the lower side of the bearing pin.

DETAILED DESCRIPTION OF THE INVENTION

Figure 1:
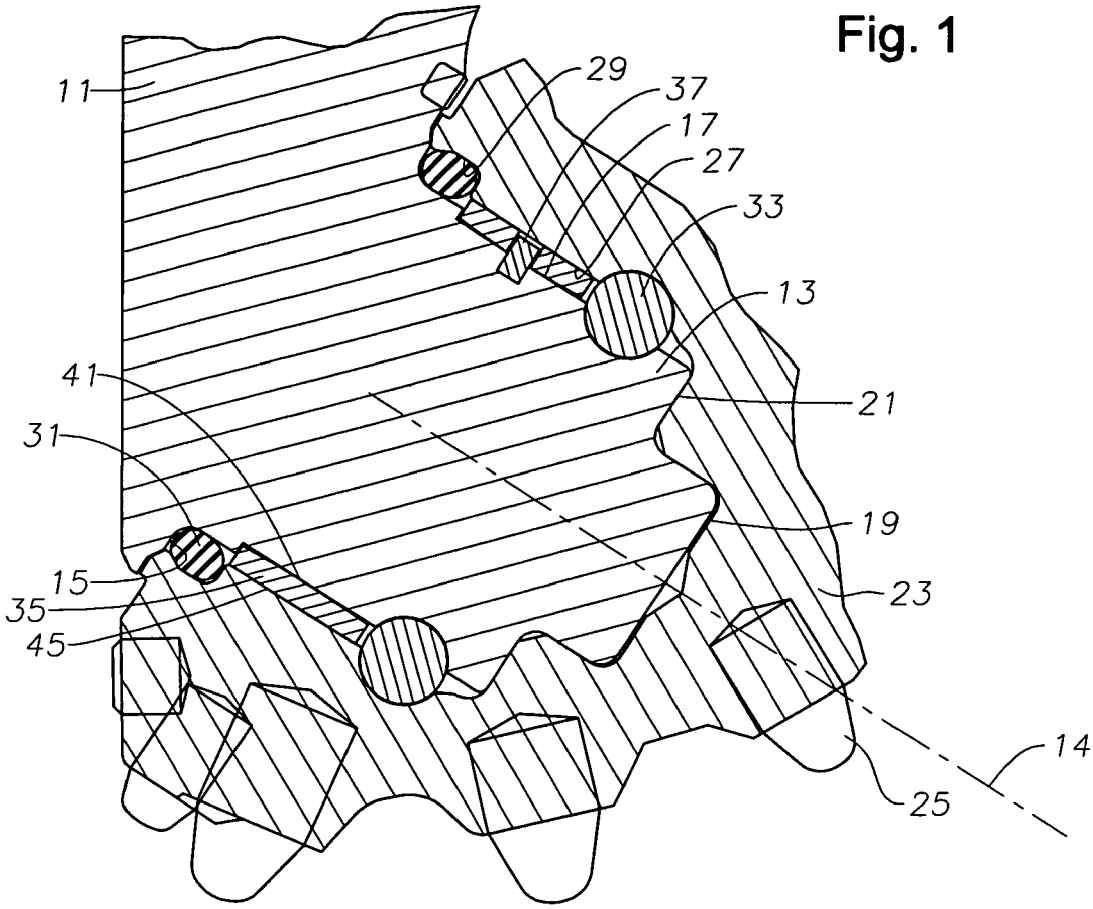
FIG. 1 comprises a partial vertical sectional view of an earth-boring bit constructed in accordance with this invention.

Referring to FIG. 1, the bit has a body 11 that has three depending legs, although only one is shown. Each leg of bit body 11 has a bearing pin 13 that extends downward and inward toward the axis of rotation of the bit. Bearing pin 13 has a bearing pin axis 14. The annular surface 15 surrounding the junction of bearing pin 13 with bit body 11, referred to sometimes as the "last machined surface", is generally flat and in a plane perpendicular to bearing pin axis 14. Bearing pin 13 has a central load-bearing surface 17 of a selected length extending from last machined surface 15 concentric with bearing pin axis 14. Bearing pin 13 has a nose 19, which typically is a cylindrical member of smaller diameter than central surface 17. A flat, annular thrust bearing surface 21 is located at the junction of nose 19 with central surface 17.

A cone 23 mounts on and rotates relative to bearing pin 13. Cone 23 has a plurality of cutting elements 25, which in this embodiment are shown to be tungsten carbide inserts press-fitted into mating holes in cone 23. Alternatively, cutting elements 25 may comprise teeth machined integrally into the exterior of cone 23. Cone 23 has a central cavity with a cylindrical portion 27 approximately the same length as bearing pin central surface 17. An annular groove or gland 29 is formed near or at the mouth of cavity cylindrical portion 27 for receiving a seal 31. Seal 31 may be of a variety of types. In this embodiment, it comprises an elastomeric ring. Bearing pin 13 and the interior of cone 23 have mating grooves for receiving a locking element 33 to retain cone 23 on bearing pin 13 but still allow rotation. In this embodiment, locking element 33 comprises a plurality of balls, but it could alternatively comprise a snap ring.

Figure 2:
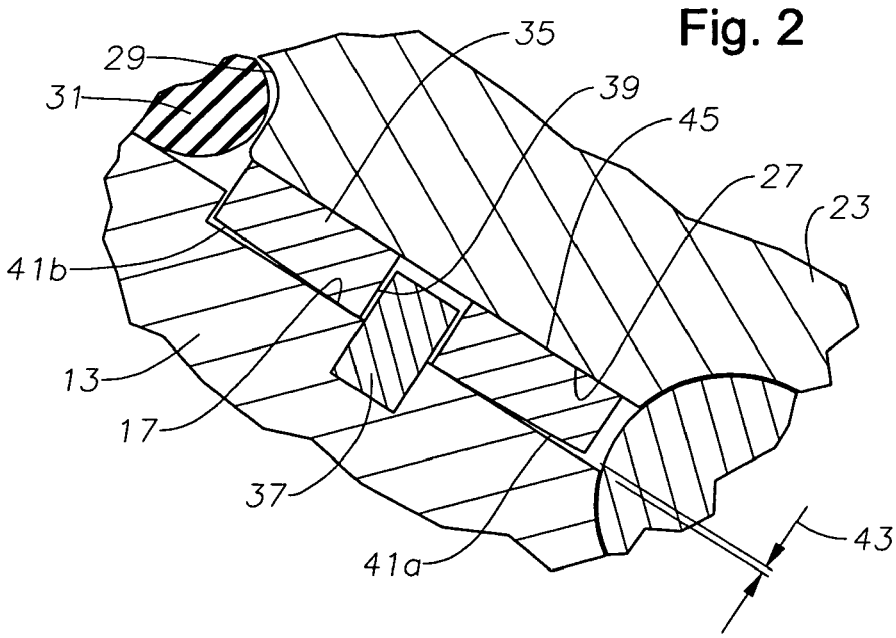
FIG. 2 is a partial enlarged sectional view of an upper portion of the bearing pin and bearing sleeve of the bit of FIG. 1.

An insert 35, which in this embodiment comprises a sleeve, is located between bearing pin central surface 17 and cone cavity cylindrical portion 27. Sleeve 35 is fixed against rotation relative to bearing pin 13, but is free to float slightly axially and also to tilt slightly relative to bearing pin axis 14. An anti-rotation member prevents sleeve 35 from rotating relative to bearing pin 13. In this embodiment, the anti-rotation member comprises a pin 37 that is secured in a hole in bearing pin central surface 17, but other devices are feasible, such as splines. In the embodiment of FIG. 2, pin 37 extends into a hole 39 of larger diameter than pin 37 and located in sleeve 35 approximately midway between the forward and rearward ends of sleeve 35. The rearward end of sleeve 35 is closely spaced to but forward of seal 31. The forward end of sleeve 35 is closely spaced to but rearward from locking element 33.

Either the interior of sleeve 35 and/or a portion of bearing pin central surface 17 are slightly contoured to facilitate tilting of sleeve 35 relative to bearing pin axis 14 while under load. In this example, sleeve 35 has an interior surface 41 with a varying inner diameter, and bearing pin central portion 27 is cylindrical. A generally conical forward portion 41*a* converges from a larger diameter at the forward end of sleeve 35 to a minimum inner diameter at the midpoint along the length of sleeve 35. A generally conical rearward inner diameter portion 41*b* converges from a larger diameter at the rearward end of sleeve 35 to the same minimum inner diameter at the midpoint of sleeve 35. Inner diameter portions 41*a* and 41*b* may be straight conical surfaces or they may be curved at a desired radius. The minimum inner diameter portion at the midpoint is preferably rounded. Furthermore, although preferred to be the same in axial length as well as conical angle, the forward and rearward portions 41*a*, 41*b* could differ somewhat from each other.

Bearing pin central portion 17 is cylindrical in this example, thus the two conical or tapered surfaces 41*a*, 41*b* result in clearances 43 between central portion 17 and contoured surfaces 41*a*, 41*b* when the bit is unloaded. When there is no load on the bit, as illustrated in FIGS. 1 and 2, the centerlines of cone 23, sleeve 35 and bearing pin 13 are substantially coaxial. In the no load condition in this embodiment, clearance 43 at the forward end will be the same as at the rearward end. Also, clearances 43 at the forward and rearward ends of sleeve 35 will be annular and uniform around bearing pin 17. Clearance 43 between forward inner diameter portion 41*a* and bearing pin central portion 17 decreases progressively from the forward end to the midpoint area. Clearance 43 between rearward inner diameter portion 41*b* and bearing pin central portion 17 decreases progressively from the rearward end to the midpoint area.

The outer diameter 45 of sleeve 35 is preferably cylindrical for forming a journal bearing surface with cone cavity central portion 27. Various coatings and inlays could be provided in one or more of the surfaces 27, 45. Sleeve 35 could be made of a variety of materials or a combination of materials, such as steel, bronze, carbide or diamond. Although cone cavity central portion 27 is shown to be an integral part of the body of cone 23, it could comprise a separate sleeve that is shrunk-fit or otherwise secured within cone 23. Also, although a journal bearing surface is preferred, individual cylindrical roller elements could be utilized in the alternative between sleeve outer diameter 45 and cone cavity 27.

In the operation of the embodiment of FIGS. 1 and 2, the bit will be lowered into a borehole and rotated about a bit axis, causing each cone 23 to rotate relative to sleeve 35 and bearing pin 13. A heavy weight is imposed on the bit from the weight of the drill string. The downward force is transmitted through bearing pin central portion 17 to cone 23 and to the bottom of the borehole. A component of the force will transmit through sleeve 35 to cone central portion 27. This component may cause cone 23 to cock or tilt slightly relative to bearing pin 13. The tilting of cone 23 may be in a clockwise or a counterclockwise direction relative to the position shown in FIG. 1, depending on the interaction between cone 23 and the earth formation. Referring to FIG. 2, when the cone tilting is in a clockwise direction, clearance 43 on the upper side and forward end of bearing pin 13, with sleeve diameter portion 41*a* making substantially flush contact with bearing pin central portion 17. At the same time, clearance 43 on the upper side and rearward end of bearing pin 13 will increase. On the lower side of bearing pin 17, the reverse occurs. Clearance 43 on the lower side and forward end will increase and decrease at rearward inner diameter portion 41*b*. The contact between the outer diameter 45 of sleeve 35 and the central portion 27 in cone 23 remains parallel even though the bit is loaded. The axes of cone 23 and sleeve 35 tilt slightly relative to bearing pin axis 14. Sleeve 35 thus pivots about bearing pin 13 when the bit is loaded. The load varies while drilling, thus this pivoting action will change as different drilling conditions are encountered.

Figure 3:
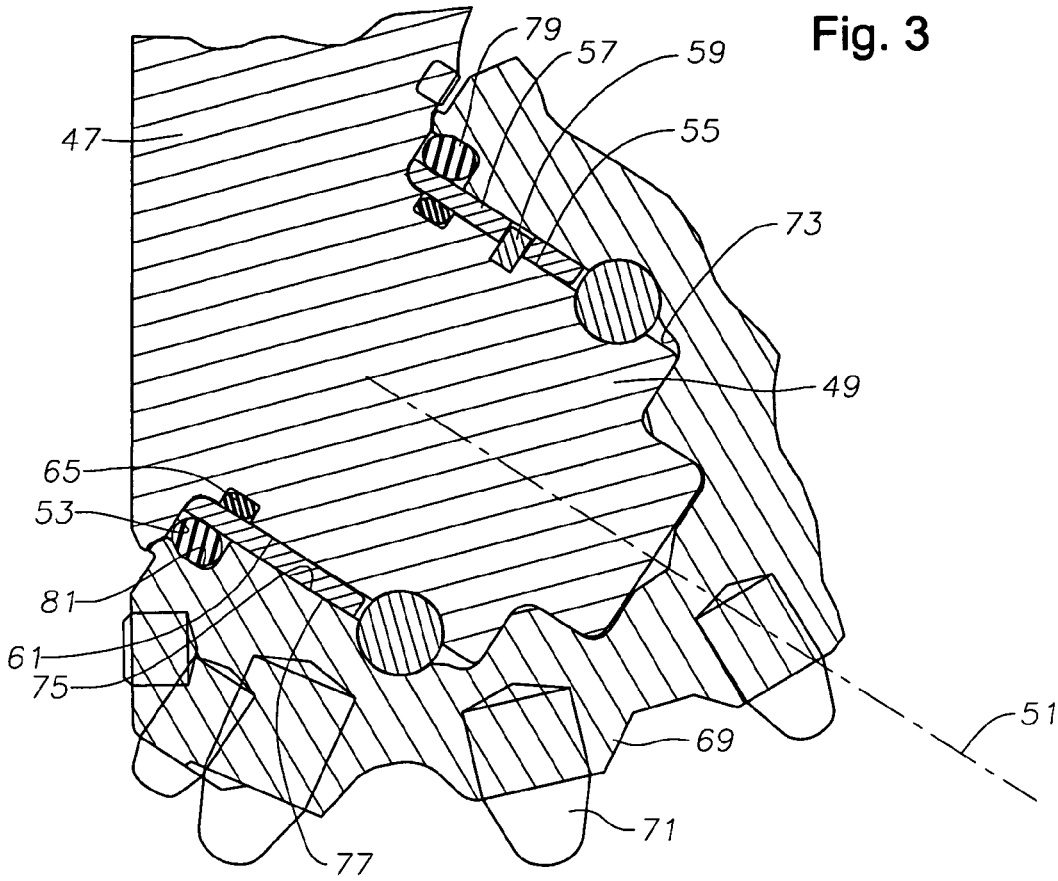
FIG. 3 is a sectional view of an alternate embodiment of a bit constructed in accordance with this invention.

The embodiment of FIG. 3 has a bit body 47 with a bearing pin 49 having a bearing pin axis 51, as in the first embodiment. The last machined surface 53 surrounds the junction of bearing pin 49 with the bit leg and bit body 47. Bearing pin 49 has a central load bearing surface 55 as in the first embodiment.

In this embodiment, insert 57 also comprises a sleeve 57 mounted on bearing pin 49. Sleeve 57 is constructed generally the same as in the first embodiment, except that it extends substantially to last machined surface 53. Sleeve 57 is secured against rotation by a pin 59. Sleeve 57 has an inner surface 61 with a conical forward portion 61*a* and a conical rearward portion 61*b*, each converging to a midpoint area. A clearance 63 between inner surface 61 and bearing pin central surface 55 converges from each end of sleeve 57 to a minimum inner diameter in the central area when the bit is unloaded. In this embodiment, an inner seal 65 seals the inner diameter of sleeve 61 to bearing pin 49. Inner seal 65 is preferably located within a groove 67 formed on bearing pin 49 near its rearward end.

Cone 69 may be the same as cone 23 of the first embodiment, having cutting elements 71 and a cavity 73. Cavity 73 has a cylindrical bearing surface 75 that slidingly engages a sleeve bearing surface 77 located on the outer diameter of sleeve 57. Bearing surfaces 75, 77 are cylindrical and may be formed in the same manner as surfaces 27 and 45 of the first embodiment.

An outer seal 79 seals between an outer diameter portion of sleeve 57 and a gland 81 formed in cone cavity 73 near its mouth. Outer seal 79 may be a variety of types and is shown to be an elastomeric ring. Normally outer seal 79 will rotate with cone 69, and its inner diameter will slide and seal against the outer diameter of sleeve 57.

Figure 4:
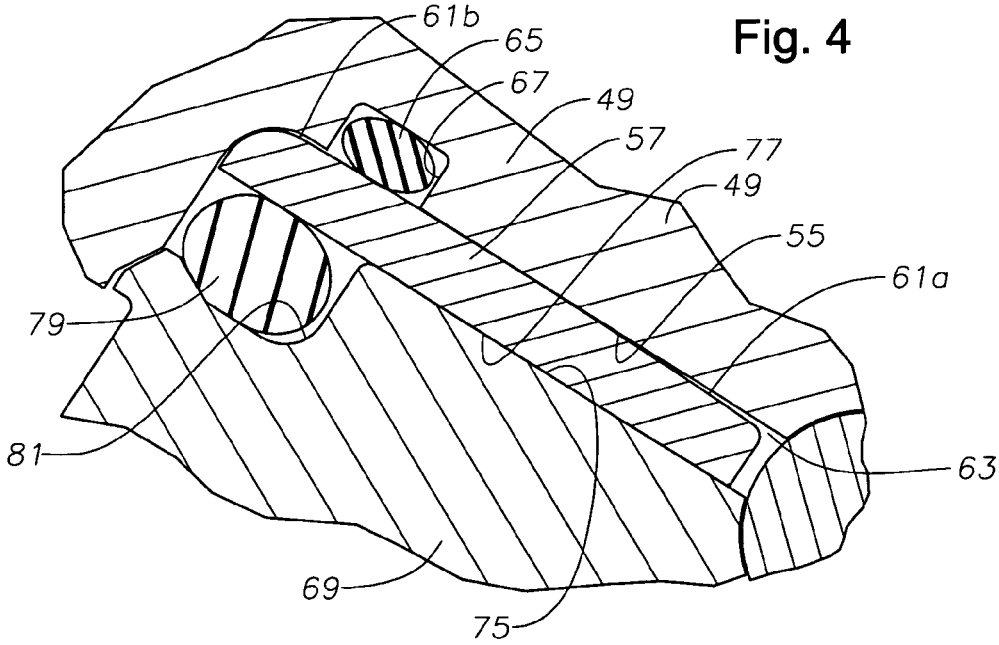
FIG. 4 is a partial enlarged sectional view of a lower portion of the bearing pin and bearing sleeve of the bit of FIG. 3.

As explained in connection with the first embodiment, when load is applied to bit body 47, it transfers from bearing pin 49 through cone 69 and to the bottom of the borehole. Slight cocking or tilting results. Referring to FIG. 4, when the tilting is in a clockwise direction, clearance 63 on the lower forward end of sleeve 57 increases. Clearance 63 will decrease on the lower rearward side at inner diameter portion 61*b*. The contact pressure on the lower side of inner seal 65 will increase. The reverse occurs on the upper side of bearing pin 49. On the upper side, clearance 63 decreases on the forward inner diameter portion 61*a* and increases on the rearward portion 61*b*. Because the tilting is facilitated by the contour of inner diameter portions 61*a*, 61*b*, cone 69 does not tilt or cock relative to sleeve 57. This allows the contact area of the journal bearing surfaces 75, 77 to remain uniform on the lower side of bearing pin 49. The pressure on seal 69 will remain more uniform because of the lack of tilting between the two surfaces that it seals against. More uniform pressure provides for better lubrication of seal 69, uniform sealing efficiency and longer seal life.

Figure 5:
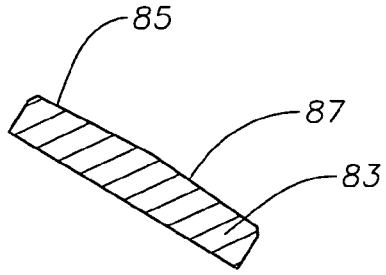
FIGS. 5-12 are sectional views of alternate embodiments of a lower side of a bearing sleeve in accordance with this invention, each shown apart from the bearing pin.

FIGS. 5-12 illustrate a few of the many variations for the contours on the insert. Referring to FIG. 5, in this embodiment, insert 83 comprises a sleeve, of which a lower portion is shown. Sleeve 83 has an inner diameter with a rearward tapered section 85 and a forward tapered section 87 that join each other in the mid-section, equidistant between the forward and rearward ends of sleeve 83. Sleeve 83 is similar to sleeve 35 of FIG. 2, except the rearward and forward sections 85, 87 are straight conical surfaces, not curved. In some cases, the forward section 87 could be cylindrical and the rearward section 85 tapered.

Figure 6:
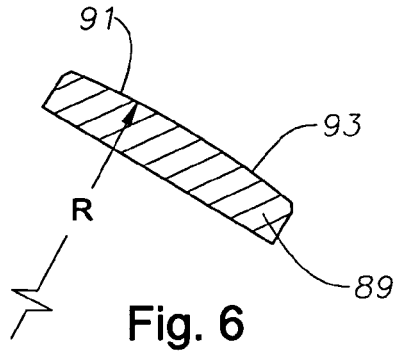

Referring to FIG. 6, in this embodiment, insert 89 comprises a sleeve, of which a lower portion is shown. Sleeve 89 has an inner diameter with a rearward curved conical section 91 and a forward curved conical section 93 that join each other in the mid-section, equidistant between the forward and rearward ends of sleeve 89. Sleeve 89 is similar to sleeve 83 of FIG. 5, except the rearward and forward sections 91, 93 are curved, such as at a radius R. If desired, forward section 93 could be cylindrical or tapered, rather than curved.

Figure 7:
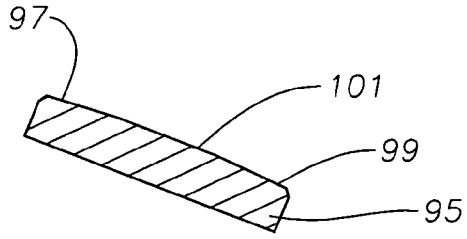

Referring to FIG. 7, in this embodiment, insert 95 comprises a sleeve, of which a lower portion is shown. Sleeve 95 has an inner diameter with a rearward tapered section 97, a forward tapered section 99 and a cylindrical mid-section 101. Forward and rearward sections 99, 97 may be tapered as in FIG. 5, curved as in FIG. 6, or other shapes.

Figure 8:
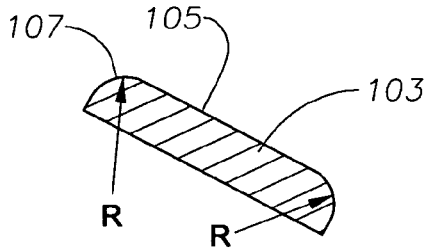

Referring to FIG. 8, in this embodiment, insert 103 comprises a sleeve, of which a lower portion is shown. Sleeve 103 has a cylindrical inner diameter 105 with ends that are formed at a radius R. If desired, the radius R may be placed on only one of the ends.

Figure 9:
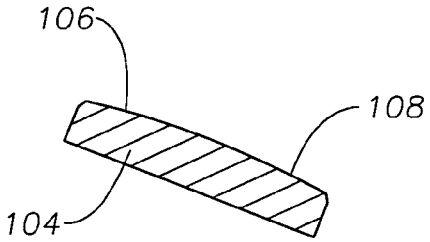

Referring to FIG. 9, in this embodiment, insert 104 comprises a sleeve, of which a lower portion is shown. Sleeve 104 has an inner diameter with a rearward section 106 formed as a logarithmic curve. In this example, sleeve 104 has a forward tapered section 108 that is also tapered along a logarithmic curve. Forward section 108 alternately may be cylindrical, tapered, curved or other shapes.

Figure 10:
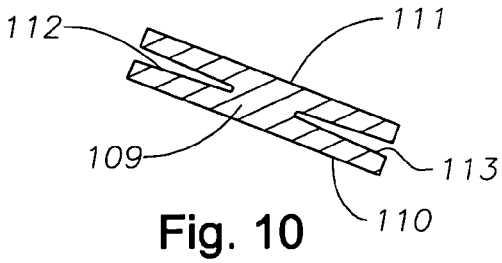

Referring to FIG. 10, in this embodiment, insert 109 comprises a sleeve, of which a lower portion is shown. Sleeve 109 has an outer diameter 110 and an inner diameter 111 that are cylindrical and concentric under no load conditions. A slit or cavity 112 extends forward from the rearward edge, and a similar cavity 113 extends rearward from the forward edge. Cavities 112, 113 may be annular or located just on the lower side of the bearing pin (not shown). The forward and rearward cavities 112, 113 are separated from each other by a central section that joins inner diameter 111 with outer diameter 110. Preferably the width of rearward cavity 112 decreases or converges in a forward direction. Similarly, the width of forward cavity 113 decreases in a rearward direction. Inner diameter 111 will fit closely and stationarily on a bearing pin (not shown), and outer diameter 110 will be in sliding engagement with a bearing surface in the cone (not shown). Cavities 112, 113 define the contour that makes sleeve 109 compliant so that the cone can tilt about the central section of sleeve 109.

Figure 11:
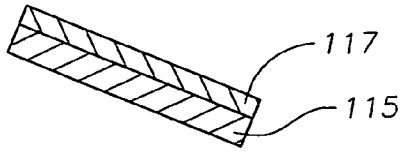

In FIG. 11, insert 115 comprises a rigid sleeve with a compliant resilient liner 117 bonded to its inner diameter. Liner 117 may be formed of an elastomeric material. The inner diameter of liner 117 is cylindrical and in stationary contact with a bearing pin (not shown). The outer diameter of sleeve 115 serves as a bearing surface for the cone. Liner 117 allows the cone to tilt slightly relative to the bearing pin while maintaining its bearing surface parallel with the outer diameter of sleeve 115.

Figure 12:
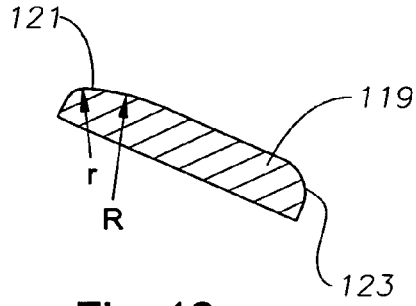

FIG. 12 illustrates a sleeve 119 with a rearward section 121 formed at a compound curve, having a large radius R joining a smaller radius r at the end. Forward section 123 is shown as having a cylindrical section and a curved corner formed at a single radius. Forward section 123 could have other shapes.

Figure 13:
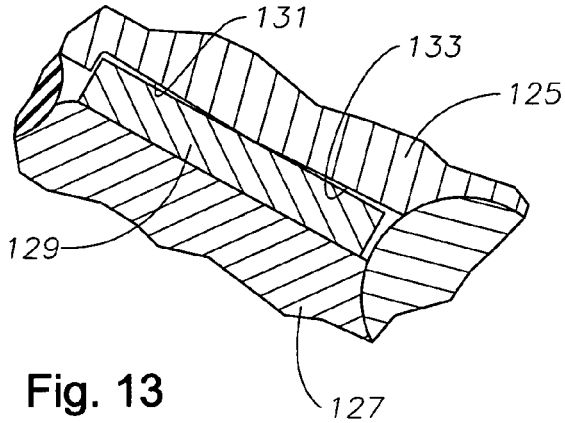
FIG. 13 is a partial sectional view of the lower side of another embodiment of a bearing pin and sleeve in accordance with this invention.

FIG. 13 shows a lower portion of a bearing pin 125 and a cone 127. An insert comprising a sleeve 129 is mounted between cone 127 and bearing pin 125. Sleeve 129 has cylindrical inner and outer diameters in this example, and preferably does not rotate with cone 127. A contoured surface is formed on at least the lower portion of bearing pin 125 and comprises a rearward section 131 and an optional forward section 133. In this example, sections 131 and 133 are tapered, thus are straight conical surfaces. However, they could have a number of other shapes, as described in connection with FIGS. 5-12. Sections 131 and 133 provide clearances that allow sleeve 129 and cone 127 to tilt slightly relative to bearing pin 125 while maintaining parallel contact between cone 127 and sleeve 129.

Figure 14:
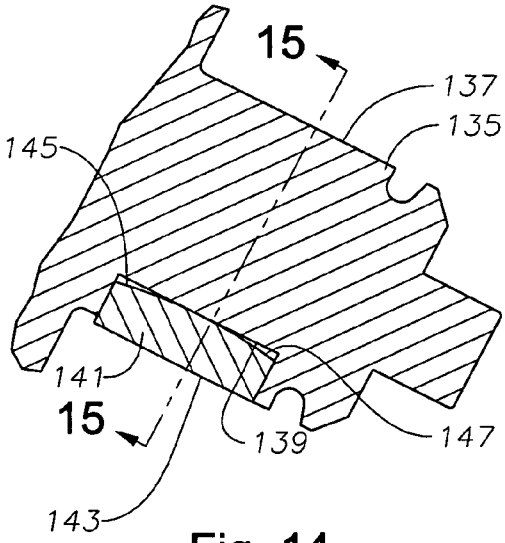
FIG. 14 is a sectional view of another embodiment of bearing pin, the bearing pin having a sleeve segment in accordance with this invention.
Figure 15:
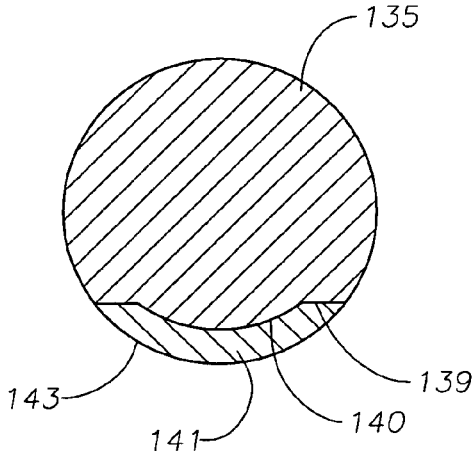
FIG. 15 is a sectional view of the bearing pin of FIG. 14, taken along the line 15-15 of FIG. 14.

Referring to FIGS. 14 and 15, in this embodiment, bearing pin 135 has a recess 139 formed on its lower side. Recess 139 extends along most of the length of bearing pin 135 and extends circumferentially an amount between about 45 degrees and 135 degrees, as shown in FIG. 15. Preferably recess 139 has a convex cylindrical base portion 140. Insert 141 comprises a segment of a sleeve rather than a full 360 degree sleeve as in the other embodiments. Insert 141 substantially fills recess 139 and has an outer surface 143 that has a diameter the same as the outer diameter of bearing pin 135. A contour is provided between the mating surfaces of recess base 140 and insert 141 to provide a clearance. In this example, the contour is formed on insert 141 and comprises curved conical sections 145 and 147, similar to the embodiment of FIG. 6. The contour could take other shapes or forms, such as those shown in FIGS. 5-12, or it could be formed on recess base 140 instead.

The invention has significant advantages. The floating and non-rotating sleeve reduces points of high contact stress in the bearing due to tilting or cocking of the cone when loaded. In the second embodiment, the sleeve also reduces high stress concentrations that might otherwise occur to the lubricant seal.

While the invention has been shown in only some of its forms, it should be apparent to those skilled in the art that it is not so limited but is susceptible to various changes without departing from the scope of the invention.

We claim:

1. An earth-boring bit, comprising:

a bit body having a depending bearing pin with a bearing pin axis;

an insert mounted on and fixed against rotation relative to the bearing pin, the insert having a forward end and a rearward end;

a cone having a cavity that slidably receives the insert;

wherein an exterior portion of the bearing pin and an inner surface of the insert define a tapered clearance between them on at least one end of the insert when the bit is unloaded; and the tapered clearance allowing the insert to be tiltable a slight amount relative to the bearing pin under some bit operating conditions so as to maintain substantially parallel mating surfaces between the cone and the insert.

2. The bit according to claim 1, wherein said at least one tapered clearance comprises a forward clearance at the forward end and a rearward clearance at the rearward end of the insert, the forward and rearward clearance joining a midsection of the insert that serves as a fulcrum to allow tilting of the insert relative to the bearing pin.

3. The bit according to claim 2, wherein the midsection of the insert is rounded.

4. The bit according to claim 1, wherein the exterior portion of the bearing pin engaged by the insert is cylindrical, and the inner surface of the insert has a contoured section converging from one of the ends of the insert to a central portion of the insert to define the clearance.

5. The bit according to claim 1, wherein the clearance is defined by a substantially straight conical surface formed on an inner surface of the insert.

6. The bit according to claim 1, wherein the insert comprises a sleeve and wherein the bit further comprises:

an inner seal between the bearing pin and the sleeve at the rearward end of the insert;

an outer seal between the cone and the sleeve at the rearward end of the insert; and wherein said tilting of the insert changes contact stress on the inner seal.

7. The bit according to claim 1, said tilting of the insert causes the clearance to close completely.

8. The bit according to claim 1, wherein:

the tapered clearance extends from only the rearward end of the insert.

9. An earth-boring bit, comprising:

a bit body having a depending bearing pin with a bearing pin axis;

an insert mounted on and fixed against rotation relative to the bearing pin;

a cone having a cavity that slidably receives the insert; and wherein an exterior portion of the bearing pin and an inner surface of the insert define a clearance between them that changes along a portion of a length of the bearing pin when the bit is unloaded; and wherein the inner surface of the insert is cylindrical and the exterior portion of the bearing pin engaged by the insert has forward and rearward sections that are contoured to define the clearance.

10. An earth-boring bit, comprising:

a bit body having a depending bearing pin with a bearing pin axis;

an insert in engagement with the bearing pin and fixed against rotation about the bearing pin axis, the insert having an outer bearing surface;

a cone having an inner bearing surface that slidably engages the outer bearing surface of the insert;

wherein an exterior portion of the bearing pin and an inner portion of the insert are configured to define a clearance between them on a lower side of the bearing pin with a rearward portion that progressively decreases in a forward direction from a rearward end of the insert; and the clearance being dimensioned such that under some bit operating conditions, the insert is movable relative to the bearing pin, causing the clearance to close.

11. The bit according to claim 10, wherein the clearance also has a forward portion that progressively decreases in a rearward direction from a forward end of the insert;

the forward portion of the clearance being separated from the rearward portion of the clearance by a fulcrum that allows the insert to tilt relative to the bearing pin axis under some operating conditions.

12. The bit according to claim 10, wherein the insert comprises a sleeve surrounding the bearing pin and the bit further comprises:

a outer seal located between the cone and the insert at a rearward end of the insert;

an inner seal located between the sleeve and the bearing pin at a rearward end of the insert; and wherein said movement of the insert changes contact stress on the inner seal without substantially affecting contact stress on the outer seal.

13. The bit according to claim 10, wherein the insert comprises a segment of a sleeve located in a recess formed on a lower side of the bearing pin, and wherein the insert has an outer surface that is the same distance from the bearing pin axis as an outer surface of the bearing pin on an upper side of the bearing pin.

14. The bit according to claim 10, wherein the insert comprises a sleeve.

15. The bit according to claim 10, wherein:

the inner and outer bearing surfaces remain substantially parallel with each other under all load conditions.

16. An earth-boring bit, comprising:

a bit body having a depending bearing pin with a bearing pin axis;

a sleeve surrounding the bearing pin, the sleeve being fixed against rotation relative to the bearing pin during operation of the bit;

a cone rotatably mounted on the sleeve, the cone and the sleeve defining a journal bearing between them for transferring load on the bit during operation from the bearing pin to the cone;

mating locking grooves in the cavity of the cone and on the bearing pin;

a locking element in the locking grooves to retain the cone on the bearing pin;

the sleeve having a rearward end adjacent a junction of the bit body with the bearing pin and a forward end adjacent the locking grooves;

an inner seal sealingly engaging the bearing pin and the sleeve at the rearward end of the sleeve;

an outer seal sealingly engaging the cone and the sleeve at the rearward end of the sleeve; and wherein the sleeve is movable radially relative to the bearing pin axis under some operating conditions, which changes contact stress on the inner seal.

17. The bit according to claim 16, wherein the inner seal is located within a groove formed in the bearing pin.

18. The bit according to claim 16, wherein the bearing comprises a cylindrical inner diameter portion in the cone that slides against a cylindrical outer diameter portion on the sleeve.

19. The bit according to claim 18, wherein the inner and outer seals comprise elastomeric rings.

* * * * *